US010866015B2

(12) United States Patent
Clements

(10) Patent No.: US 10,866,015 B2
(45) Date of Patent: Dec. 15, 2020

(54) TURBINE COOLING FAN

(71) Applicant: James Thomas Clements, Richmond, IN (US)

(72) Inventor: James Thomas Clements, Richmond, IN (US)

( * ) Notice: Subject to any disclaimer, the term of this patent is extended or adjusted under 35 U.S.C. 154(b) by 152 days.

(21) Appl. No.: 15/887,978

(22) Filed: Feb. 2, 2018

(65) Prior Publication Data

US 2018/0216852 A1 Aug. 2, 2018

Related U.S. Application Data

(60) Provisional application No. 62/454,023, filed on Feb. 2, 2017.

(51) Int. Cl.

| | |
|---|---|
| ***F25B 9/04*** | (2006.01) |
| ***F04D 25/16*** | (2006.01) |
| ***F01D 25/12*** | (2006.01) |
| ***F04D 25/08*** | (2006.01) |
| ***F04D 25/04*** | (2006.01) |
| ***F04D 19/00*** | (2006.01) |

(52) U.S. Cl.

CPC ..... *F25B 9/04* (2013.01); *F01D 25/12* (2013.01); *F04D 19/002* (2013.01); *F04D 25/04* (2013.01); *F04D 25/08* (2013.01); *F04D 25/166* (2013.01); *F05D 2210/12* (2013.01); *F05D 2260/209* (2013.01)

(58) Field of Classification Search

CPC ..... F25B 9/04; F01D 25/12; F04D 19/002; F04D 25/04; F04D 25/08; F04D 25/166; F05D 2210/12; F05D 2260/209

USPC ..... 416/97 R; 62/5

See application file for complete search history.

(56) References Cited

U.S. PATENT DOCUMENTS

| | | | | |
|---|---|---|---|---|
| 3,630,040 A * | 12/1971 | Goldfarb | B60H 1/3204 | 62/5 |
| 4,333,754 A * | 6/1982 | Peter | F25B 9/04 | 181/403 |
| 4,594,084 A * | 6/1986 | Lopez | B60H 1/00007 | 62/5 |
| 6,691,926 B1 * | 2/2004 | Moen | F25C 3/04 | 239/14.1 |

* cited by examiner

*Primary Examiner* — Justin M Jonaitis
(74) *Attorney, Agent, or Firm* — Derek Clements

(57) ABSTRACT

Embodiments are provided for a cooling fan that has a vortex tube, an air turbine, and one or more fan blades. The vortex tube is capable of being supplied with compressed air and splitting the compressed air into a cold stream and a hot stream. The cold stream can spins said air turbine with attached fan blades, causing said fan blades to spin and blow cold air.

13 Claims, 3 Drawing Sheets

SECTION A-A

SECTION B-B

TURBINE COOLING FAN

CROSS-REFERENCE TO RELATED APPLICATIONS

This application claims priority to U.S. Provisional Application No. 62/454,023 filed Feb. 2, 2017. The content of the above application is incorporated by reference in its entirety.

FIELD OF THE DISCLOSURE

The present invention relates generally to fans, and more particularly to a turbine cooling fan and method of cooling of people or objects in warm environments.

BACKGROUND

The cooling of electronic equipment, people, and other apparatus by means of fans located in or around an object, to be cooled is a conventional expedient. The typical fan is supported in a free-standing cabinet, which also encloses the motor directly driving an air blower or fan, together with the controls for such apparatus. In selecting a suitable fan to cool a given piece of equipment or person, a multitude of factors must be considered before an intelligent choice of the particular type of fan can be used. Some of these factors include the size of the fan to be used, the power consumption, the efficiency, moisture considerations, and the temperature of the environment to name a few.

However, in many of applications, especially in connection with electronic equipment and metal in factories, cooling capability and not introducing moisture are some of the most important considerations. On the sideline of sporting events or in front of large crowds on a hot day, the cooling capability is the most importing consideration. Because a motor generates heat and because the cabinet is open, it is always the case that the typical fan simply blows warm air and circulates hot air, such as that accomplished when a fan is attached to the motor output shaft, does a less than adequate job at keeping the people or equipment cool since the air surrounding the motor and air it is circulating is not cool.

Air conditioners remove the heat from the interior of an occupied space, and solve the problem of cooling and dehumidifying the rooms they are installed in. They often use a fan to distribute the conditioned air to distribute into a large space but must be able to vent the hot air they produce outside, and thus are not optimal for applying direct cooling or cooling outdoors.

Thus, a way to directly cool electronic components, metal, factory equipment, and people by means of a cooling fan that does not introduce moisture into the environment is needed.

The disclosed system is directed to overcoming one or more of the problems set forth above.

SUMMARY

The disclosure presented herein relates to a fan and method of cooling. More specifically, a fan and method of cooling using air supplied from a vortex tube to spin an air turbine, allowing a user of the fan or method of cooling to cool a person or object even when, for example the person or object that needs to be cooled is located outside or where the introduction of moisture would not be desirable. In one or more non-limiting examples, air supplied to a vortex tube, by either a motor, shop compressor, or other means, exits the vortex tube and spins a turbine that is connected to fan blades. Those of ordinary skill will appreciate that other uses may be foreseeable also and are included within the scope of the present description.

In one aspect, or more embodiments for a turbine fan are provided m the present description whereby the turbine fan includes a vortex tube, an air turbine, and one or more fan blades. In further non-limiting embodiments, the turbine fan also includes one or more of the following: a motor, heat exchangers, bearings, an air compressor, separation panel, and a cabinet. In a non-limiting embodiment, the cabinet encloses an air compressor, a motor, vortex tube, air turbine, heat exchangers, and one or more fan blades. In one embodiment, where shop compressed air is available, the motor and air compressor are not required. Further, in another embodiment the one or more fan blades and air turbine are secured within the cabinet. They are secured to the front of a separation panel or partition which separate a hot and a cold section of the cabinet. In a further embodiment, the motor and the compressor, when needed to supply air are mounted on back side the cabinet's separation panel. In this embodiment, the vortex tube protrudes thru said separation panel to provide cold air to power the turbine, resulting in fan spinning dispersing cold air.

The preceding and following embodiments and descriptions are for illustrative purposes only and are not intended to limit the scope of this disclosure. Other aspects and advantages of this disclosure will become apparent from the following detailed description.

Definitions

A vortex tube is a mechanical device that separates a compressed gas into hot and cold streams. Pressurized gas is injected tangentially into a swirl chamber and accelerated to a high rate of rotation. Due to the conical nozzle at the end of the tube, only the outer shell of the compressed gas, is allowed to escape at that end. The remainder of the gas is forced to return, in an inner vortex of reduced diameter within the outer vortex.

A turbine is a machine for producing continuous power in which a wheel or rotor, typically fitted with vanes, is made to revolve by a fast-moving flow of water, steam, gas, air, or other fluid.

An air turbine is a turbine driven by airflow.

An air compressor is a device that converts power (using an electric motor, diesel or gasoline engine, etc.) into potential energy stored in pressurized air (i.e., compressed air). By one of several methods, an air compressor forces more and more air into a storage tank, increasing the pressure.

Air receivers are tanks used for compressed air storage.

A heat exchanger is a device used to transfer heat between a solid object and a fluid, or between two or more fluids. The fluids may be separated by a solid wall to prevent mixing or they may be in direct contact.

A bearing is a machine element that constrains relative motion to only the desired motion and reduces friction between moving parts. The design of the bearing may, for example, provide for free linear movement of the moving part or for free rotation around a fixed axis.

DETAILED DESCRIPTION

Figure 1:
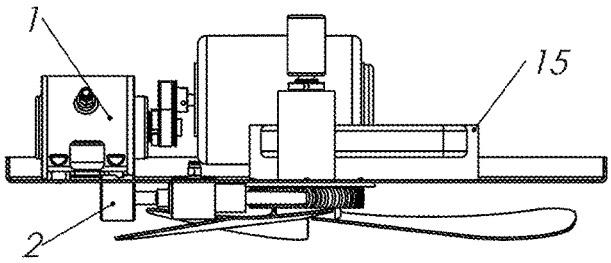
FIG. 1 is a section view of the FIG. 2 turbine cooling fan according to various aspects of the present, disclosure.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used, herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100 and includes both 25 and 100.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description includes one or more embodiments for a turbine fan and method of cooling, where compressed air is inserted into a vortex tube that cools said air, and upon leaving the vortex tube the cooled air spins an air turbine that has one or more fan blades attached. The spinning of the air turbine, and thus the one or more air blades, causes the blades to push said cooled air toward the desired object to be cooled. The one or more embodiments for turbine fan and cooling method include multiple elements for supplying the compressed air to the turbine fan. For example, in one or more embodiments, various motors, compressors, and air receiving tanks may be attached to the turbine fan. Elements included herein are meant to be illustrative, rather than restrictive. Persons having ordinary skill in the art relevant to the present disclosure may understand there to be equivalent elements that may be substituted with the present disclosure without changing the essential function or operation of the device.

Figure 2:
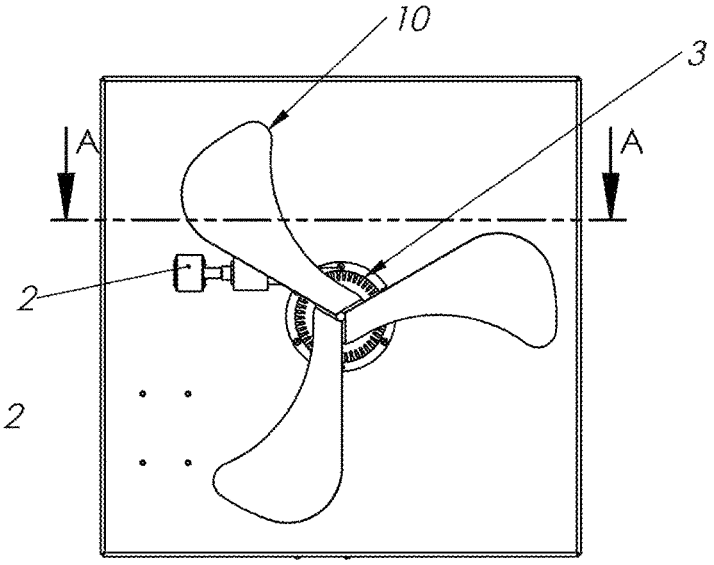
FIG. 2 is a front view of the present turbine cooling fan according to Various aspects of the present disclosure.

Turning to FIG. 1, FIG. 1 shows a section view of the FIG. 2 turbine cooling fan according to various aspects of the present disclosure. In one or more embodiments, this turbine fan may include an air compressor 1 that supplies compressed air through heat exchangers 15 to the vortex tube 2. In one embodiment, the turbine fan does not have heat exchangers, and air is supplied directly from the air compressor 1 to the vortex tube.

FIG. 2 shows a front view of the turbine fan. In one embodiment, this view shows the vortex tube 2 outlet located next to the air turbine 3. In this embodiment, after the air goes from the compressor 1, through the heat exchangers 15, through the vortex tube 2, the air spins the air turbine 3. In one embodiment, the air turbine 3 is fitted with vanes to allow said air turbine 3 to revolve by the fast-moving air as it exits the vortex tube 2. In another embodiment, said air turbine is fitted with flaps or any other means that allows the air turbine to capture, and be pushed by, the exiting air from the vortex tube 2, creating the spinning motion.

The air turbine 3, as shown in FIG. 2, is located inside of a panel. In order to allow the air turbine 3 to spin, bearings are used to allow the air turbine 3 to be connected to the panel while maintaining the capability to spin from the air flowing from the vortex tube 2. These bearing can include sleeve bearings, rifle bearings, ball bearings, fluid bearings, magnetic bearings, or any other bearing type that allows the air turbine 3 to spin while still be connected to the fan. In another embodiment, the air turbine does not use, bearings, but utilizes any other method commonly used by turbines to accomplish the task of being able to spin the air turbine while attached to a stationary object.

In the FIG. 2 embodiment, the fan blades are attached to the air turbine 3. In this embodiment, as the air exiting the vortex tube 2 spins the air turbine 3, the spinning blades 10 attached to said air turbine 3 spin, and said spinning fan blades 10 push the air spinning said air turbine 3, due to it being located next to the fan blades after spinning the air turbine. Since the air that spins the air turbine 3 is located next to the fan blades 10 after it spins said turbine 3, a good amount of that air is captured by the fan blades 10 and directed in a direction away from the fan. Additionally, air around the fan is likely to be captured by the fan blades 10 and directed away from the fan as well. This air will be pushed, and directed towards, the direction the fan is pointed.

In the FIG. 2 embodiment that fan has 3 fan blades 10. In another embodiment, the fan has one fan blade, and in further embodiments, it has multiple fan blades.

The compressor shown in FIG. 1 is used to supply compressed air to the vortex tube 2. In some embodiments, the compressor is a device that converts power into potential energy. In one embodiment, this is accomplished by forcing air into a storage tank to increase the pressure. In one embodiment, the turbine fan includes an air receiving tank, that allows the turbine fan to store compressed air. In this embodiment the turbine fan does not have to be turned on every time the fan is used, as it has a supply of compressed air. In a further embodiment, the turbine fan does not sore the compressed air, and the air compressor must constantly be making more compressed air during use.

In one embodiment, the turbine fan further includes a motor. This motor can be gas powered or electric, and is used to power the compressor 1. Compressors that do not have a built-in source of energy require a motor to be powered. In one embodiment, the turbine fan has a electric motor and is required to be plugged into an electric outlet in order to power the motor.

In a further embodiment, when the fan is being used in a setting that has access to compressed air, such as in a tool shop or factory, the turbine fan, does not need a motor or compressor. In this embodiment, the turbine fan can connect to the source of the compressed air, and attach directly to the heat exchangers. In this embodiment the air would flow through the heat exchangers to vortex tube. In even a further embodiment, the turbine fan does not have heat exchangers either, and the compressed air can connect directly into the vortex tube.

The heat exchangers 15 are used to transfer heat out of the air after it exits the compressor. In one embodiment, these heat exchangers are used to remove the heat from the air after it is supplied from an external compressed air source, such as a factory compressed air tank. In one embodiment, the heat exchangers are common fan heat exchangers that are commonly used with fans.

The vortex, tube, as show in FIGS. 1 and 2, is a mechanical device that separates the compressed air, into a hot and a cold stream, after it leaves the compressor 1 and heat exchanger. In another embodiment, the turbine fan does not have a compressor or heat exchanger, and the vortex tube is separating the air directly from an external compressed air source. In a further embodiment, the external compressed air is connected to a heat exchanger, and the air flows to the vortex tube, and the turbine does not have a compressor. After the compressed air is injected into the vortex tube, in one embodiment, it enters a swirl chamber and is accelerated to a high rate of rotation. In this embodiment, doe to the conical nozzle at the end of the tube, only the outer shell of the compressed gas is to escape at that end (the cold stream), and the remainder of the gas is forced to return in an inner vortex of reduced diameter with the outer vortex (the hot stream). In one embodiment of the turbine fan, only the cold stream is used to push the air turbine, and the hot stream is discarded out the back of the fan.

Figure 3:
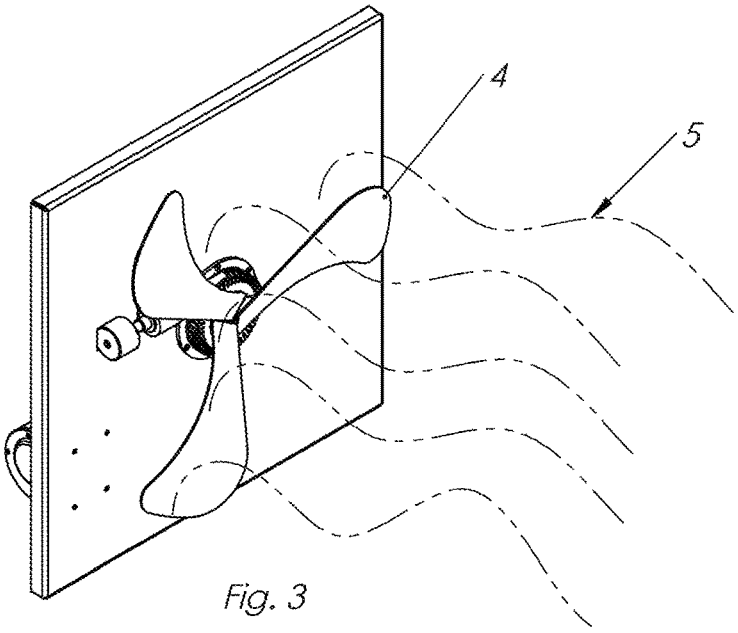
FIG. 3 is an isometric view of the turbine cooling fan according to various aspects of the present disclosure.

Turning to FIG. 3, an isometric view of one embodiment of the turbine fan is shown. In this embodiment, an electric motor powers a compressor that pushes compressed air through the heat exchangers to remove heat from the compressed air, and into a vortex tube that separates the compressed air into a hot and a cold stream. In this embodiment, the hot stream is exhausted out of the back of the fan, behind the panel for prevent it from being blown by the fan blades 4, and the cold stream is used to spin the air turbine. The spinning air turbine also spins the connected fan blades 4. These spinning fan blades 4 push the cold air 5 that is exiting the cold stream outlet of the vortex tube, and spinning the air turbine, towards the desired object, or person that needs to be cooled. This embodiment of the cooling fan is advantageous over known fans as it allows for the blowing of cold air from the vortex tube. Further, this cold air does not introduce moisture, and can be used in factories where water can cause rust or ruin electronics. Further, this fan has the advantage that is can be used outside to cool, unlike traditional air conditioners that have to exhaust their hot air in a separate area than what is being cooled to be effective, and fans that cannot blow cold air.

Figure 4:
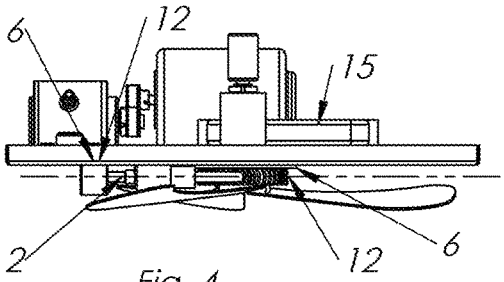
FIG. 4 is a top view of one embodiment of the turbine cooling fan according to various aspects of the present disclosure.

FIG. 4 is a top view of one embodiment of the turbine cooling fan according to various aspects of the present disclosure. In this embodiment, when vortex tube 2 exhaust the hot and the cold air streams (exhaust vents 6), they travel through noise suppressors 12. These noise suppressors can include a piece of cloth or cotton at the tip of the exhaust the air passes through, deflectors that deflect the sound waves, a wire screen, or any other means to make the exhausting air quieter. These noise suppressors are meant to make the fan quieter to improve the users experience when operating the fan, and serve to lower the hissing sound of the venting air out of the vortex tube, through both the cold stream and hot stream exhaust.

Figure 5:
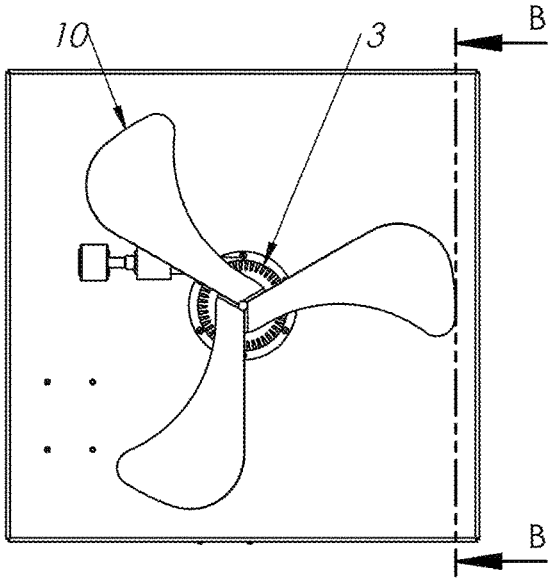
FIG. 5 is a front view of one embodiment of the turbine cooling fan according to various aspects of the present disclosure.

FIG. 5 is a front view of one embodiment of the turbine cooling fan according to various aspects of the present disclosure. This embodiment shows the fan blades 10 and the air turbine 3 from a front view.

Figure 6:
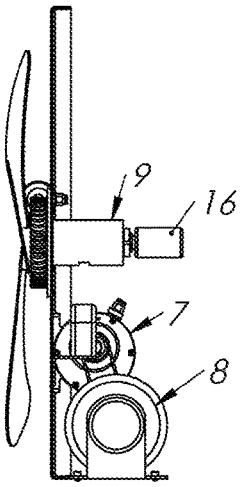
FIG. 6 is a section view of the FIG. 5 turbine cooling fan according to various aspects of the present disclosure.

FIG. 6 is a section view of the FIG. 5 turbine cooling fan according to various, aspects of the present disclosure. In this embodiment, the electric motor 8 is seen powering the compressor 7. Additionally, the bearing assembly 9 is shown with an attached booster motor 16. The booster motor 16 is an additional motor used to help spin the fan blades on larger embodiments, where the air pressure coming from the vortex tube is not enough to spin the air turbine 3. This can be a problem when the fan blades 10 are too heavy, and a booster motor 16 is required to help spin the blades. In one embodiment, booster motor 16 can be any motor commonly used to spin fan blades. In a further embodiment, the booster motor and the air pressure blowing the air turbine 3 work in conjunction to spin the fan blades 10.

In the FIG. 6 embodiment, the air stream is capable of spinning the air turbine at least partially. This means that, when the fain blades 10 are too heavy to spin the air turbine by the cold stream alone, the air stream is at least capable of starting to spin the air turbine. This could include the slightest amount of movement when the vortex is exhausting cold air. In this embodiment, the booster motor 16 assist in spinning the fan blades 10 by spinning the air turbine.

Figure 7:
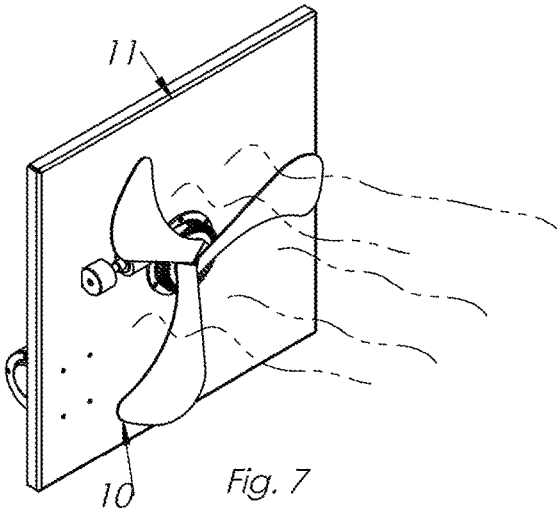
FIG. 7 is an isometric view of one embodiment of the turbine cooling fan according to various aspects of the present disclosure.

FIG. 7 is an isometric view of one embodiment of the turbine cooling fan according to various aspects of the present disclosure. In this embodiment, separation panel 11 is shown. In this embodiment, the separation panel 11 is used to separate the cold air that exits the vortex tube and spins the air turbine and fan blades 10, from that hot air stream that is exhausted from the vortex tube. In this embodiment, the hot vortex tube is embedded inside of the separation panel, and the hot air stream is vented out the back and the cold air is blown by the fan blades 10 towards the desired object or person to be cooled. In further embodiments, the vortex tube is not embedded into the separation panel, but the hot air is still exhausted behind the fan and the cold air is blown. The separation panel serves the purpose of preventing the hot air from mixing with the cold air and prevents the fan blades 10 from blowing the hot air.

Figure 8:
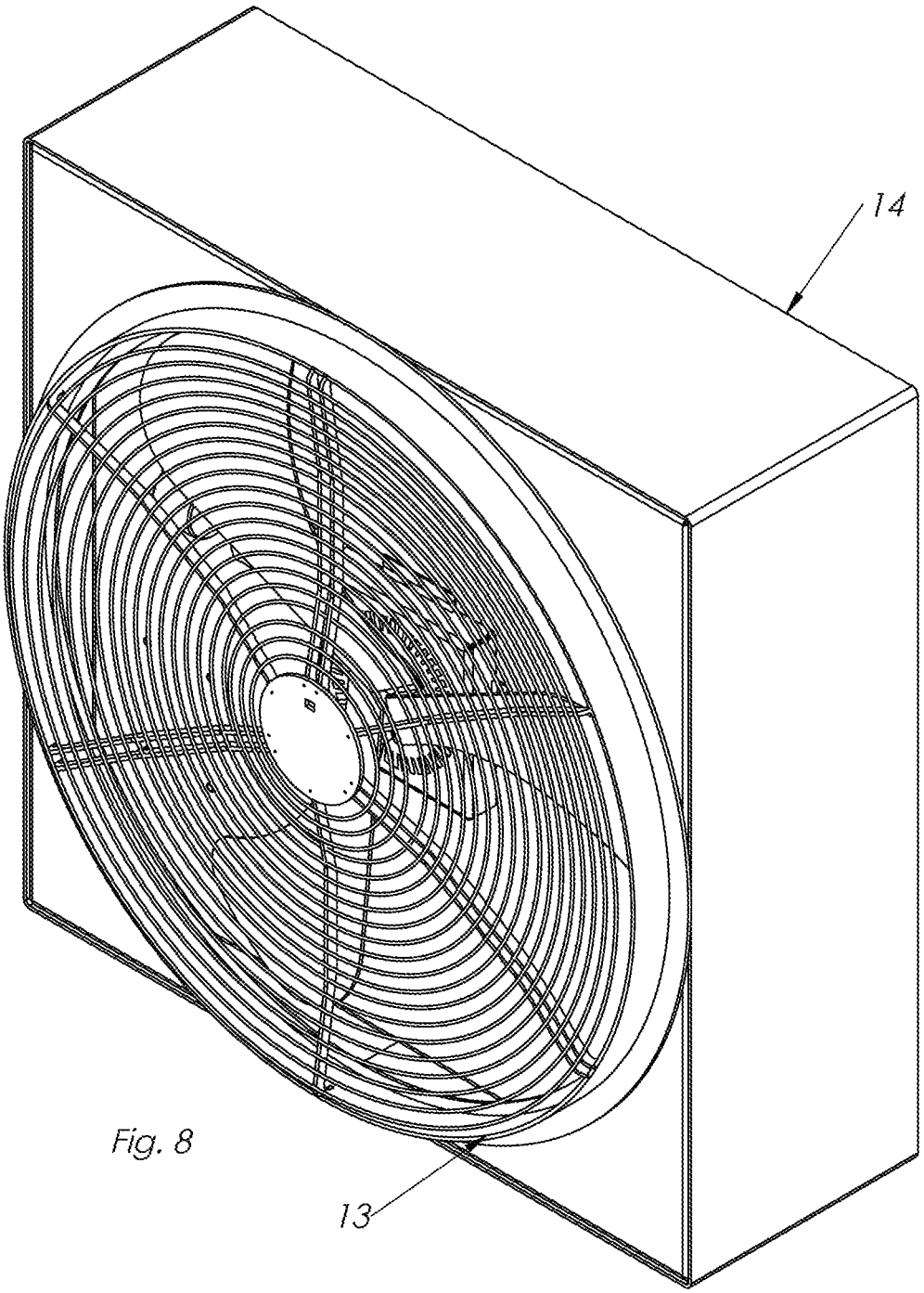
FIG. 8 is an isometric view of one embodiment of the turbine cooling fan inside of a cabinet according to various aspects of the present disclosure.

FIG. 8 is an isometric view of one embodiment of the turbine cooling fan inside of a cabinet according to various aspects of the present disclosure. This embodiment shows the turbine fan located inside of cabinet 14, and finger guard 13 on the front of said housing. The cabinet 14 is used to house the fan and serves the purpose of protecting the components of the fan from physical damage, make the fan more aesthetically pleasing, prevent physical injury to the user, allows the fan to be stackable, and allow for easier transportation. The finger guard 13 serves the purpose of protecting a user from getting their fingers cut by the spinning fan blades.

Advantageously, the present, description provides one or more embodiments of various types of turbine fans. Each turbine fan depicted herein provides advantages that overcome shortcomings of other types of fans that are used conventionally. Further, the various embodiments shown in the figures and described herein accommodate different purposes and may be used in various applications, including, but not limited, blowing cold air to cold people or an object without introducing moisture. It is noted that the various embodiments of the turbine fan presented herein may be used in many other ways other than to blow cold, air to cool a person. For example, the various turbine fans may generally be used to improve the cooling of industrial manufactured components. Thus, the various embodiments described in the present description include a number of novel and helpful components that provide enhanced cooling fans to benefit a user.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A fan comprising:

a vortex tube, said vortex tube exhausting, a hot air stream and a cold air stream;

an air turbine that is configured to be spun by said exhausted cold air stream;

a compressor configured to generate compressed air;

a heat exchanger configured to cool air;

at least one fan blade, wherein said at least one fan blade is connected to said air turbine, wherein compressed air is configured to flow from said compressor through said heat exchanger before flowing through said vortex tube, in the vortex tube the air is split into said hot and said cold air streams, said cold air stream is exhausted from said vortex tube and spins said air turbine, and said spinning air turbine spins said at least one fan blade.

2. The fan of claim 1 further comprising: a motor, wherein said motor powers said compressor.

3. The fan of claim 1 further comprising: a noise suppressor located on an exhaust located on the vortex tube.

4. The fan of claim 1 further comprising: a separation panel, whereby said separation panel is capable of preventing said hot air stream and said cold air stream from mixing together.

5. The fan of claim 4 further comprising: bearings, said bearings capable of allowing said air turbine to spin while remaining attached to said separation panel.

6. The fan of claim 1 further comprising: a booster motor, wherein said booster motor is capable of assisting in the spinning of said air turbine.

7. The fan of claim 1 further comprising: a cabinet.

8. The fan of claim 1 further comprising: a finger guard.

9. The fan of claim 4, whereby said hot air stream is exhausted behind said separation panel, and said cold air stream is exhausted in front of said separation panel.

10. The fan of claim 6 wherein compressed air flows from said compressor, through said heat exchanger, through said vortex tube, wherein the air is split into said hot and said cold air streams, wherein the cold air stream spins said air turbine and is blown by said fan blades.

11. A method for blowing cold air, the method comprising:

providing the fan of claim 6;

compressing air using the air compressor;

cooling said compressed air using the heat exchanger;

separating said cooled air into the hot and the cold air stream;

exhausting said cold air stream towards the air turbine having attached fan blades; and spinning said air turbine having attached fan blades with said exhausted cold air stream; and blowing said exhausted, cold air stream using said spinning fan blades.

12. The method of claim 11 further comprising exhausting said hot air stream away from said air turbine.

13. The method of claim 11 further comprising powering said compressor with a motor.

* * * * *